US006289707B1

(12) United States Patent
Saarenko

(10) Patent No.: US 6,289,707 B1
(45) Date of Patent: Sep. 18, 2001

(54) APPARATUS FOR MANUFACTURING ROOFING OR CLADDING PANELS

(75) Inventor: Pekka Saarenko, Kuopio (FI)

(73) Assignee: Samesor Oy, Kuopio (FI)

( * ) Notice: Subject to any disclaimer, the term of this patent is extended or adjusted under 35 U.S.C. 154(b) by 0 days.

(21) Appl. No.: 09/479,444

(22) Filed: Jan. 7, 2000

Related U.S. Application Data

(63) Continuation of application No. 09/319,421, filed on Jun. 2, 1999, now abandoned.

(30) Foreign Application Priority Data

Dec. 2, 1996 (FI) ..... 964809

(51) Int. Cl.[7] ..... B21D 5/08; B21D 13/04
(52) U.S. Cl. ..... 72/177; 72/180; 72/250
(58) Field of Search ..... 72/177, 180, 179, 72/182, 250

(56) References Cited

U.S. PATENT DOCUMENTS 754,786 * 3/1904 Lockwood ..... 72/181
790,797 * 5/1905 Little ..... 72/180
1,936,228 * 11/1933 Crafton ..... 72/180
4,250,728 * 2/1981 King ..... 72/177
4,444,037 * 4/1984 Norgate ..... 72/177
4,875,354 10/1989 Nilsen et al. .

FOREIGN PATENT DOCUMENTS 482 986 4/1977 (AU) .
WO 98 31893 7/1998 (WO) .

OTHER PUBLICATIONS

Patent Abstract of Japan, vol. 14, No. 127, M–947 abstract of JP 1–321024 A, Dec. 27, 1989.

* cited by examiner

*Primary Examiner*—Daniel C. Crane
(74) *Attorney, Agent, or Firm*—Klauber & Jackson

(57) ABSTRACT

An apparatus for manufacturing a roofing panel has been accomplished such that the desired panel version can be produced by altering the infeed point of the panel (6) on a feeding table (5). The apparatus can be utilized in the manufacture of roofing panels of various materials and with varied profile shapes.

8 Claims, 5 Drawing Sheets

APPARATUS FOR MANUFACTURING ROOFING OR CLADDING PANELS

This Application is a Continuation, of application Ser. No. 09/319,421, filed Jun. 2, 1999, now abandoned.

The invention relates to an apparatus for manufacturing roofing or cladding panels of various materials and with varied profile shapes.

Solutions of various types for manufacturing roofing and cladding panels are known. Known machines currently used in the manufacture generally produce a formed panel profile of one single type. If a different panel profile is to be produced in the same machine, the machine tools have to be replaced.

Prior art is described below with reference to accompanying FIG. 1, which illustrates prior-art equipment for manufacturing a tile-patterned roofing panel or sheet.

Figure 1:
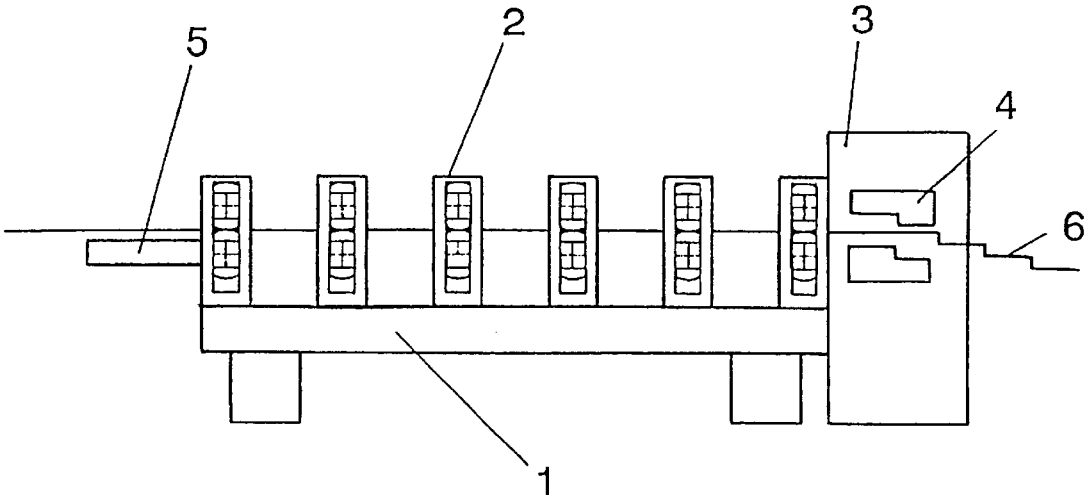
FIG.1 PRIOR ART

FIG. 1 shows a known apparatus for manufacturing tile-patterned roofing sheets. The apparatus comprises a profiling machine 1 equipped with at least one pair of rotatable profiling rolls 2, a press 3 equipped in turn with a clamping tool 4, and a feeding table 5 for guiding the sheet 6 into the machine.

In the production line of the prior-art tile-patterned roofing sheet, the sheet 6 is fed by means of the feeding table 5 into the profiling machine 1. In the profiling machine 1, the sheet 6 is formed between the rotating profiling rolls 2 in the longitudinal direction to the desired profile shape. In the press 3, a transverse fold is formed, by means of the clamping tool 4, in the sheet 6 formed in the profiling machine 1.

In such a conventional production line, the manufacture of different roofing sheet profiles requires replacement of the tools both in the profiling machine and the press. Tool replacement is slow and awkward, and additional tools will increase the investment amount substantially.

The purpose of the present invention is to provide a simpler and improved solution enabling the manufacture of profiled roofing or cladding panels which can be mounted on the roof (or on the wall) both conventionally and turned upside down (inverted). This is achieved by an apparatus having the features of appended claim 1, preferred embodiments being defined in the subclaims.

In one aspect of the invention, the apparatus for manufacturing a tile-patterned roofing or cladding panel comprises a profiling machine equipped with at least one pair of rotatable profiling rolls, a press equipped with a clamping tool, and a feeding table for guiding the panel into the machine. In the production line of the tile-patterned panel of the invention, the panel is fed by means of the feeding table into the profiling machine. In the profiling machine, the panel is formed between the rotating profiling rolls in the longitudinal direction to the desired profile shape. In the press, a transverse fold is formed, by means of the clamping tool, in the panel produced in the profiling machine.

In the apparatus according to the invention, the profiling machine and the press are provided with tools by means of which the necessary overlapping shape, including water flutes or capillary grooves, can be laminated or formed at either edge portion of the panel to be formed. By altering or switching the infeed point of the panel on the feeding table, the desired panel version can be produced. Thus, the desired panel version can be achieved in a very simple manner.

Preferably, the machine is arranged in such a way that transverse movement of the sheet or panel is allowed at the infeed point, thereby making it possible to produce the desired version of the panel.

Figure 2:
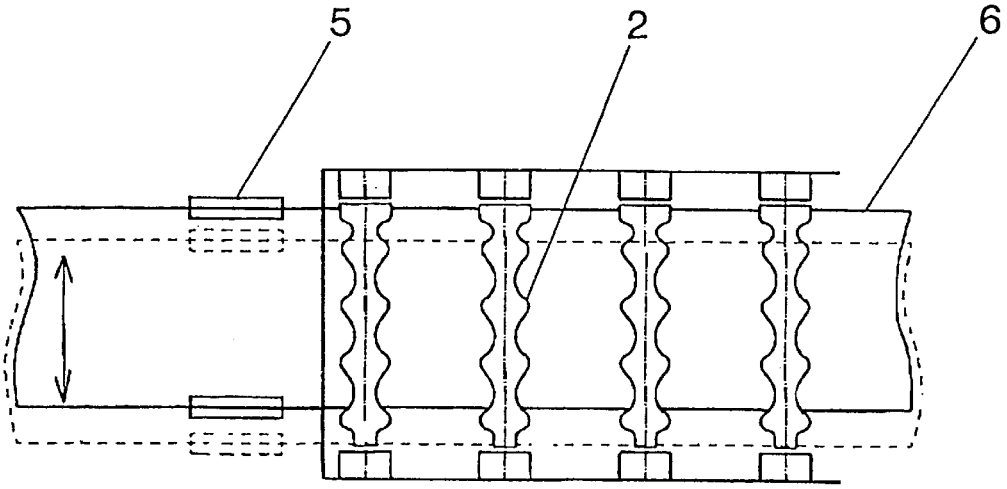
Figure 3:
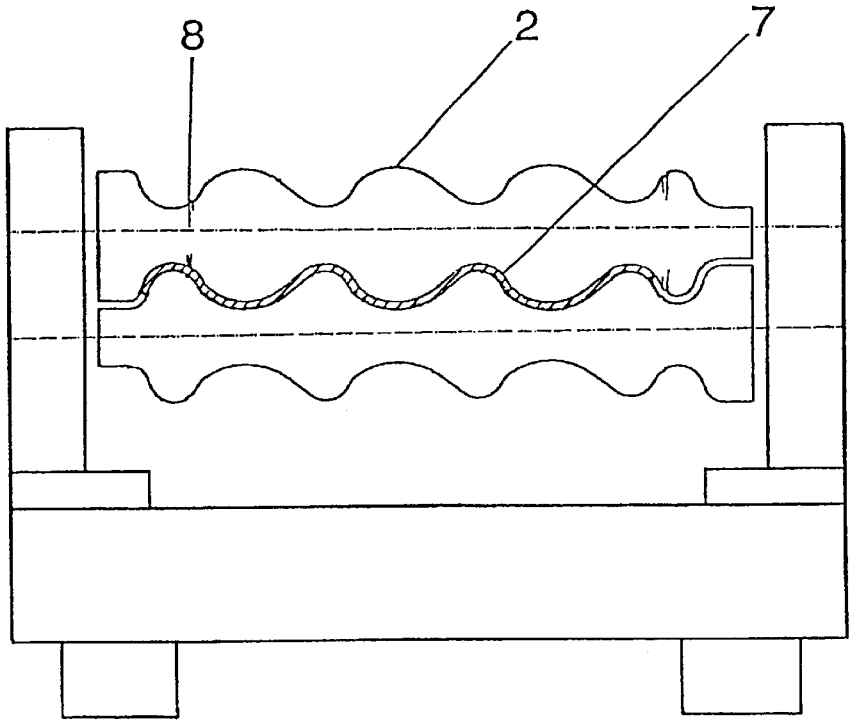
Figure 4:
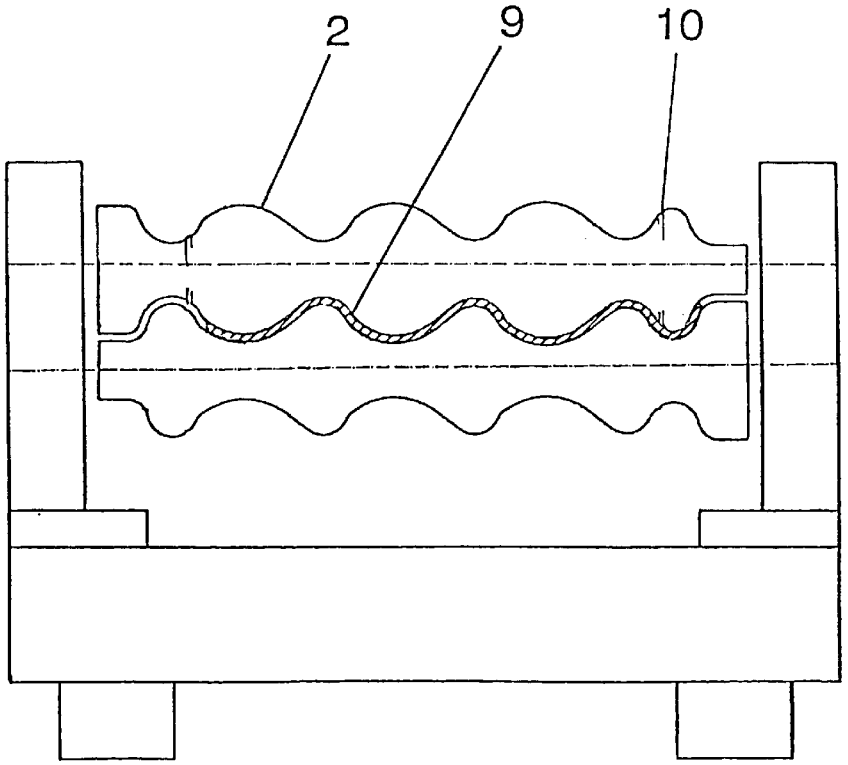
Figure 5:
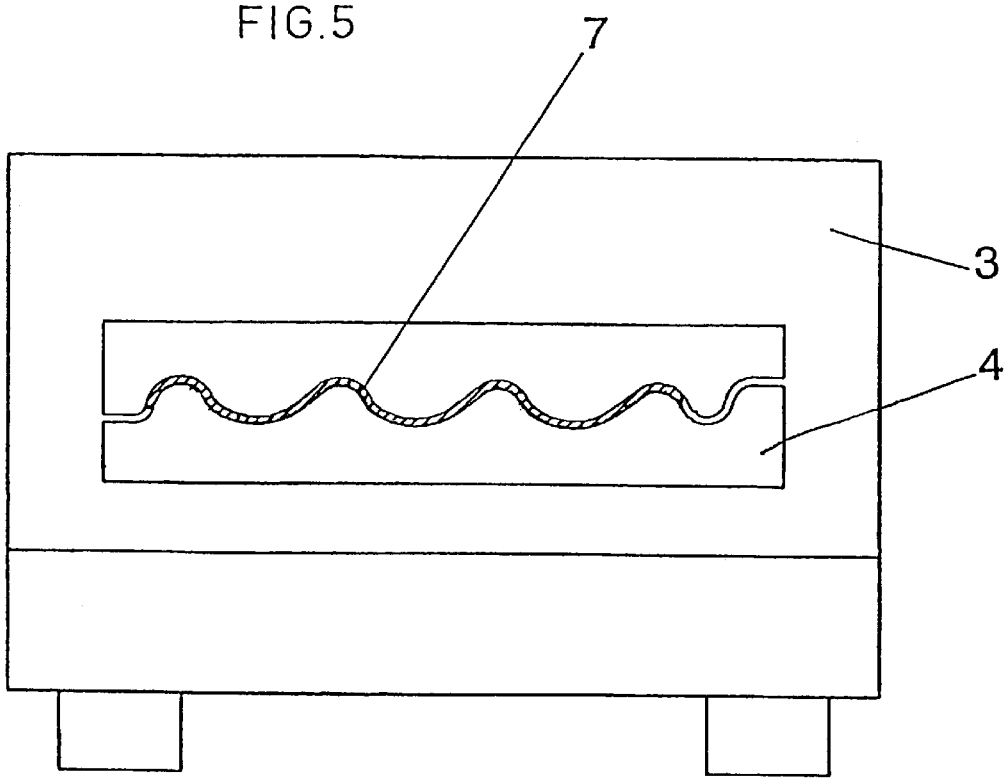
Figure 6:
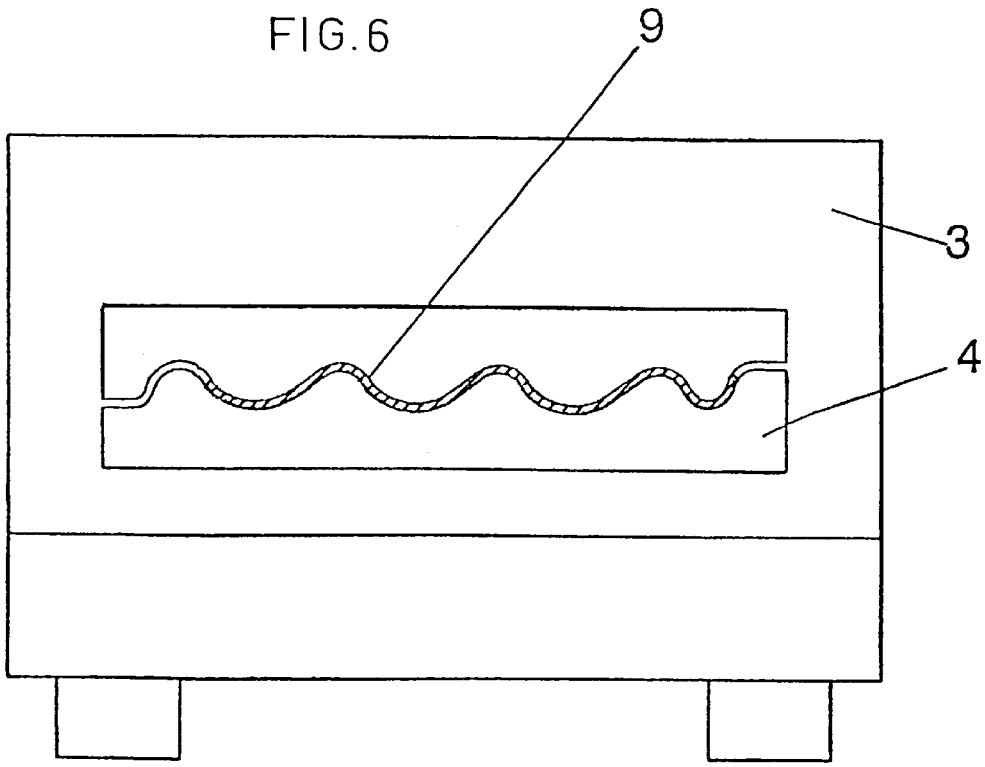
Figure 7:
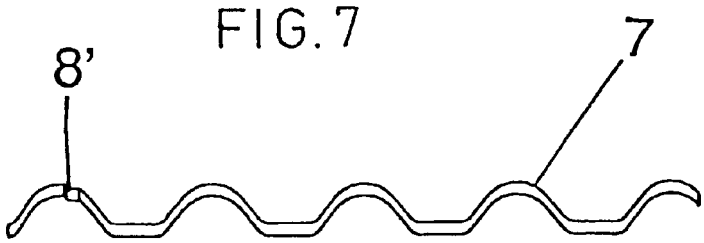
Figure 8:
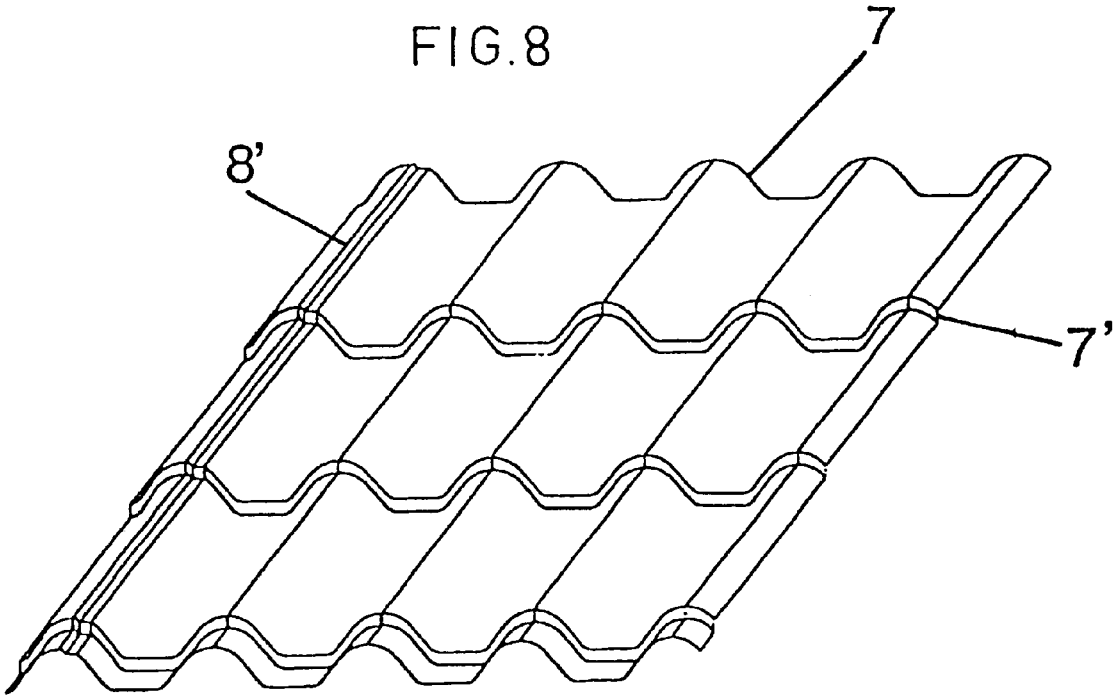
Figure 9:
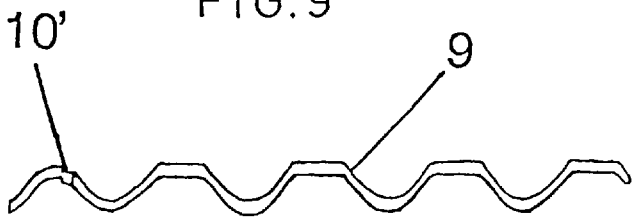
Figure 10:
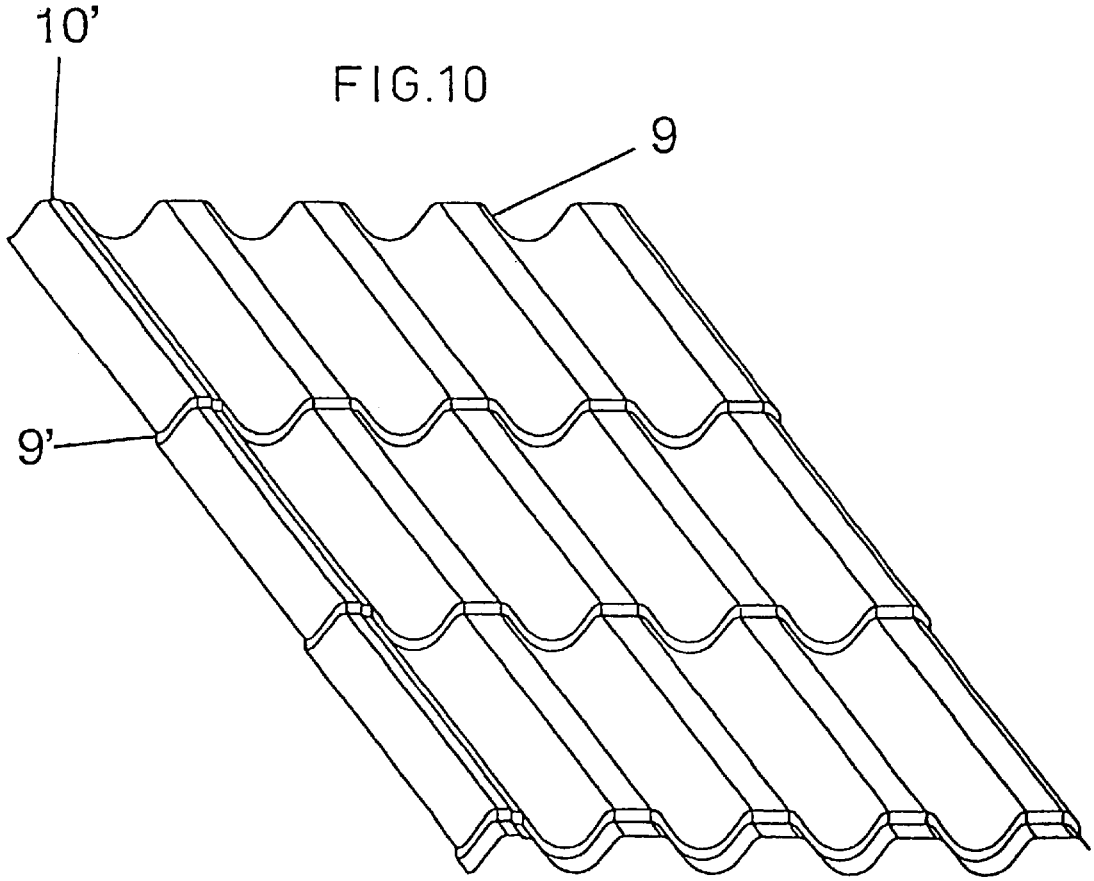

The invention will be described in greater detail below with reference to the accompanying schematic drawings, which illustrate presently preferred embodiments and in which:

FIG. 1 is a side view of a prior-art apparatus for manufacturing a tile-patterned roofing or cladding panel, FIG. 2 is a top view of an apparatus of the invention for manufacturing a tile-patterned roofing or cladding panel, FIG. 3 shows a pair of profiling rolls included in the apparatus of FIG. 2 in a situation where the panel is manufactured as a roofing sheet to be mounted conventionally, FIG. 4 shows the pair of profiling rolls of FIG. 3 in a situation where the panel is manufactured as a roofing sheet to be mounted upside down, FIG. 5 shows a press and a clamping tool included in the apparatus of the invention in a situation where the panel is manufactured as a roofing sheet to be mounted conventionally, FIG. 6 shows the press and the clamping tool of FIG. 5 in a situation where the panel is manufactured as a roofing sheet to be mounted upside down, FIG. 7 is a cross-section of a roofing sheet manufactured in an apparatus of the invention and to be mounted conventionally, FIG. 8 shows the sheet of FIG. 7 mounted conventionally, FIG. 9 is a cross-section of a roofing sheet manufactured in an apparatus of the invention and mounted upside down, and FIG. 10 shows the sheet of FIG. 9 mounted upside down.

FIG. 1 has been explained above. The solution according to the invention will be described below with reference to FIGS. 2–10, showing the implementation of the invention.

FIG. 2 is a top view of the apparatus of the invention for manufacturing tile-patterned roofing or cladding panels 6 which are also called sheets in the following description. Further, FIG. 2 shows the different positions of a feeding table 5 as the conventional and the reversed version of the roofing sheet 6 are being produced. Rotatable profiling rolls 2 of the profiling machine 1 have been designed such that the necessary overlapping shape, including longitudinal water flutes or capillary grooves, can be laminated or formed at either edge portion of the sheet 6 by altering the infeed point of the sheet 6 to be formed.

The machine 1 must be wide enough to allow transverse movement of the feeding table 5, thereby movement of the sheet 6 to be formed, as is shown by the double arrow in FIG. 2.

FIG. 3 shows the pair of rotating profiling rolls 2 of the apparatus of the invention in a situation where the panel is manufactured as a roofing sheet 7 to be, conventionally mounted. A means 8 (forming point) for forming the water flute 8' of the sheet 7 to be conventionally mounted has been marked on the pair of profiling rolls 2 (cf. FIGS. 7–8).

FIG. 4 shows the pair of profiling rolls 2 of the apparatus of the invention in a situation where the panel is manufactured as a roofing sheet 9 to be mounted upside down. A means 10 (forming point) for forming the water flute 10' of the sheet 9 to be mounted upside down has been marked on the pair of profiling rolls 2 (cf. FIGS. 9–10).

In the apparatus of the invention, the profiling machine 1 is equipped with at least one pair of profiling rolls 2, by means of which the necessary overlapping shape including the water flutes 8', 10' can be laminated or formed at either edge portion of the sheet 6 to be formed, and the desired roofing sheet version 7, 9 can be produced by simply altering the infeed point of the sheet 6 by means of the feeding table 5.

FIG. 5 shows the press and the clamping tool of the apparatus of the invention in a situation where the panel is manufactured as a roofing sheet 7 to be mounted conventionally. The press 3 is provided with a clamping tool 4 such that in the press 3 a transverse fold is formed, by means of the clamping tool 4, in the sheet 7 formed in the profiling machine 1 and to be conventionally mounted.

FIG. 6 shows the press and the clamping tool of the apparatus of the invention in a situation where the panel is manufactured as a roofing sheet 9 to be mounted upside down. The press 3 is equipped with a clamping tool 4 such that in the press 3 a transverse fold is formed, by means of the clamping tool 4, in the sheet 9 formed in the profiling machine 1 and to be mounted upside down.

FIG. 7 shows a cross-section of a roofing sheet 7, preferably a thin metal sheet, manufactured in an apparatus of the invention and to be mounted conventionally. FIG. 8 shows the roofing sheet 7 of FIG. 7 mounted conventionally and having transverse folds 7'.

FIG. 9 shows a cross-section of a roofing sheet 9, preferably a thin metal sheet, manufactured in an apparatus of the invention and to be mounted upside down. FIG. 10 shows the roofing sheet 9 of FIG. 9 mounted upside down and having transverse folds 9'.

The apparatus of the invention can be used to manufacture a roofing panel or a lining panel to be mounted conventionally or upside down also without a transverse fold.

Further, the apparatus of the invention enables two different profiled panels 7, 9 to be manufactured without tool replacement.

The manufacture is rapidly shifted from one product to another, since, depending on which panel version 7, 9 is to be manufactured, only the infeed point of the sheet 6 needs to be changed.

What is claimed is:

1. An apparatus for manufacturing roofing or cladding panels (5) comprising:

a profiling machine (1) equipped with at least one pair of rotatable profiling rolls (2), a press (3) equipped with a clamping tool (4), and a feeding table (5) for guiding the panel (6) into the machine such that the panel (6) is fed by means of the feeding table (5) into the profiling machine (1), in the profiling machine (1), the panel (6) being formed between the rotatable profiling rolls (2) in the longitudinal direction to the desired profile shape, and in the press (3), a transverse fold being optionally formed, by means of a clamping tool (4), in the panel (6) formed in the profiling machine (1), wherein the profiling machine (1) and the press (3) are equipped with tools (2, 4) by means of which said desired profile shape, including water flutes or capillary grooves (8'; 10'), is formed or laminated at either edge portion of the panel (6) to be formed, the infeed point of the panel (6) on the feeding table (5) being switchable, thereby enabling a panel having a profile shape as shown by panel (7) or panel (9) to be produced.

2. An apparatus as claimed in claim 1, wherein the profiling machine (1) is equipped with at least one pair of forming rolls (2), by means of which the necessary overlapping shape including water flutes or capillary grooves (8'; 10') can be formed or laminated at either edge portion of the panel (6) to be formed.

3. An apparatus as claimed in claim 1 or 2, wherein the press (3) is equipped with a clamping tool (4) such that, in the press (3), a transverse fold (7'; 9') is formed by means of the clamping tool (4) in the roofing or cladding panel (7, 9) formed in the profiling machine (1).

4. An apparatus as claimed in claim 1 or 2, wherein the apparatus is used to manufacture a roofing or cladding panel (7, 9) without transverse folding to be mounted conventionally or upside down.

5. An apparatus as claimed in claim 1 or 2, wherein the apparatus is used to manufacture a lining panel to be mounted conventionally or upside down.

6. An apparatus as claimed in claim 5, wherein the apparatus is used to manufacture a lining panel without transverse folding to be mounted conventionally or upside down.

7. An apparatus as claimed in claim 3, wherein the apparatus is used to manufacture a roofing or cladding panel (7, 9) without transverse folding to be mounted conventionally or upside down.

8. An apparatus as claimed in claim 3, wherein the apparatus is used to manufacture a lining panel to be mounted conventionally or upside down.

* * * * *

UNITED STATES PATENT AND TRADEMARK OFFICE

CERTIFICATE OF CORRECTION

PATENT NO. : 6,289,707 B1
DATED : September 18, 2001
INVENTOR(S) : Pekka Saarenko It is certified that error appears in the above-identified patent and that said Letters Patent is hereby corrected as shown below:

Title page,
Related U.S. Application Data, please change the information to read as follows:
-- Continuation of Application No. 09/319,421, filed as
Application No. PCT/IB97/01494 on June 2, 1999, now abandoned --

Signed and Sealed this

Twenty-third Day of April, 2002

*Attest:*

*Attesting Officer*

JAMES E. ROGAN
*Director of the United States Patent and Trademark Office*